US009514678B2

(12) United States Patent
Park et al.

(10) Patent No.: US 9,514,678 B2
(45) Date of Patent: Dec. 6, 2016

(54) PIXEL AND ORGANIC LIGHT EMITTING DISPLAY DEVICE USING THE SAME

(71) Applicant: SAMSUNG DISPLAY CO., LTD., Yongin, Gyeonggi-Do (KR)

(72) Inventors: Yong-Sung Park, Yongin (KR); Min-Hyuk Choi, Yongin (KR); Dong-Gyu Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 227 days.

(21) Appl. No.: 14/276,954

(22) Filed: May 13, 2014

(65) Prior Publication Data

US 2014/0354518 A1 Dec. 4, 2014

(30) Foreign Application Priority Data

May 31, 2013 (KR) ..... 10-2013-0062656

(51) Int. Cl.
*G09G 3/32* (2016.01)

(52) U.S. Cl.
CPC .... *G09G 3/3233* (2013.01); *G09G 2300/0819* (2013.01); *G09G 2300/0852* (2013.01); *G09G 2300/0861* (2013.01); *G09G 2310/0262* (2013.01); *G09G 2310/067* (2013.01); *G09G 2320/043* (2013.01); *G09G 2330/08* (2013.01); *G09G 2330/10* (2013.01)

(58) Field of Classification Search
CPC ..... G09G 3/3233; G09G 2310/0262; G09G 2330/10; G09G 2330/0861; G09G 2300/0819; G09G 2320/043; G09G 2330/08; G09G 2310/067; G09G 2300/0852
See application file for complete search history.

(56) References Cited

U.S. PATENT DOCUMENTS

2006/0077138 A1* 4/2006 Kim ..... G09G 3/3233 345/76
2007/0052634 A1* 3/2007 Yamazaki ..... G09G 3/3233 345/76
2008/0211397 A1* 9/2008 Choi ..... G09G 3/3233 313/504
2009/0315874 A1* 12/2009 Kim ..... G09G 3/3233 345/213

FOREIGN PATENT DOCUMENTS

KR 10-2005-0050001 A 5/2005
KR 10-2009-0131405 A 12/2009

* cited by examiner

*Primary Examiner* — Andrew Sasinowski
(74) *Attorney, Agent, or Firm* — Lewis Roca Rothgerber Christie LLP

(57) ABSTRACT

A pixel includes a plurality of organic light emitting diodes, each of which including a cathode electrode coupled to a second power source, a pixel circuit coupled to a scan line and to a data line, the pixel circuit configured to control current supplied from a first power source to the organic light emitting diodes corresponding to a data signal supplied to the data line, and first transistors between the pixel circuit and respective ones of the organic light emitting diodes, the first transistors configured to be turned on or to be turned off when a low emission control signal is supplied to a first emission control line, wherein a scan signal supplied to the scan line is a first voltage, and wherein the low emission control signal is a second voltage that is different than the first voltage.

20 Claims, 8 Drawing Sheets

PIXEL AND ORGANIC LIGHT EMITTING DISPLAY DEVICE USING THE SAME

CROSS-REFERENCE TO RELATED APPLICATION

This application claims priority to and the benefit of Korean Patent Application No. 10-2013-0062656, filed on May 31, 2013, in the Korean Intellectual Property Office, the entire contents of which are incorporated herein by reference in their entirety.

BACKGROUND

1. Field

An aspect of embodiments of the present invention relates to a pixel and an organic light emitting display device using the same.

2. Description of the Related Art

Flat panel displays include a liquid crystal display, a field emission display, a plasma display panel, an organic light emitting display, and the like.

Among these flat panel displays, the organic light emitting display is able to display images using organic light emitting diodes that emit light by the recombination of electrons and holes. The organic light emitting display has a fast response speed, and is driven with low power consumption.

In a general organic light emitting display, current corresponding to a data signal is supplied to an organic light emitting diode of a pixel, using a transistor included in the pixel, so that light is generated in the organic light emitting diode.

SUMMARY

Embodiments of the present invention provide a pixel and an organic light emitting display using the same, which can improve display quality.

According to an embodiment of the present invention, there is provided a pixel including a plurality of organic light emitting diodes, each of which including a cathode electrode coupled to a second power source, a pixel circuit coupled to a scan line and to a data line, the pixel circuit configured to control current supplied from a first power source to the organic light emitting diodes corresponding to a data signal supplied to the data line, and first transistors between the pixel circuit and respective ones of the organic light emitting diodes, the first transistors configured to be turned on or to be turned off when a low emission control signal is supplied to a first emission control line, wherein a scan signal supplied to the scan line is a first voltage, and wherein the low emission control signal is a second voltage that is different than the first voltage.

The second voltage may be greater than the first voltage.

Due to the second voltage, one of the first transistors may be configured to be turned off when the voltage of the second power source is applied to an anode electrode of a corresponding one of the organic light emitting diodes.

Due to the second voltage, one of the first transistors may be configured to be turned on when a voltage greater than that of the second power source is applied to an anode electrode of a corresponding one of the organic light emitting diodes.

The pixel may further include a driving unit configured to store a current data signal of a current frame supplied from the data line, and configured to provide a previous data signal of a previous frame to the pixel circuit.

According to another embodiment of the present invention, there is provided an organic light emitting display including a scan driver configured to supply a scan signal to scan lines, and configured to supply a high emission control signal and a low emission control signal to a first emission control line, a data driver configured to supply a data signal to data lines, and pixels corresponding to respective ones of the scan lines and the data lines, wherein each of the pixels includes a plurality of organic light emitting diodes each including a cathode electrode coupled to a second power source, a pixel circuit configured to control current supplied from a first power source to the organic light emitting diodes corresponding to the data signal, and first transistors between the pixel circuit and respective ones of the organic light emitting diodes, and configured to be turned on or turned off when the low emission control signal is supplied to the first emission control line, wherein the scan signal is set to a first voltage, and wherein the low emission control signal is set to a second voltage that is different than the first voltage.

The second voltage may be greater than the first voltage.

Due to the voltage of the second voltage, one of the first transistors may be configured to be turned off when the voltage of the second power source is applied to an anode electrode of a corresponding one of the organic light emitting diodes.

Due to the voltage of the second voltage, one of the first transistors may be configured to be turned on when a voltage that is greater than that of the second power source is applied to an anode electrode of a corresponding one of the organic light emitting diodes.

The first transistors may be configured to be turned off by the high emission control signal.

The scan driver may be configured to progressively supply the scan signal to the scan lines during a third period in one frame, and the scan driver may be configured to supply the high emission control signal to the first emission control line during a first period and a second period in the one frame, and may be configured to supply the low emission control signal to the first emission control line during the third period.

The organic light emitting display device may further include a control driver configured to supply a first control signal to a first control line commonly coupled to the pixels during the first period, and configured to supply a second control signal to a second control line commonly coupled to the pixels during the second period.

Each pixel may further include a driving unit configured to store a current data signal of a current frame supplied from a corresponding one of the data lines, and configured to provide a previous data signal of a previous frame to the pixel circuit.

The driving unit may include a second transistor between the data line and a first node, and configured to be turned on when the scan signal is supplied, a third transistor between the first node and the pixel circuit, and configured to be turned on when the second control signal is supplied, and a first capacitor between the first node and an initialization power source.

The pixel circuit may include a fourth transistor between a third node and a fourth node, and configured to control current flowing from the first power source to the first transistors according to a voltage applied to a second node, a fifth transistor between the fourth and second nodes, and configured to be turned on when the second control signal is supplied, and a storage capacitor between the second node and the first power source.

The pixel circuit may further include a sixth transistor between the second node and an initialization power source, and configured to be turned on when the first control signal is supplied, a seventh transistor between the third node and the first power source, and configured to be turned on when the first control signal is supplied, and an eighth transistor between the third node and the first power source, and configured to be turned on when the low emission control signal is supplied to the first emission control line.

The scan driver may be configured to supply the high emission control signal to a second emission control line commonly coupled to the pixels during the first period and the second period, and may be configured to supply the low emission control signal to the second emission control line during the third period.

The low emission control signal supplied to the second emission control line may be a voltage that is lower than the second voltage.

The low emission control signal supplied to the second emission control line is the first voltage.

The pixel circuit may further include a sixth transistor between the second node and an initialization power source, and configured to be turned on when the first control signal is supplied, a seventh transistor between the third node and the first power source, and configured to be turned on when the first control signal is supplied, and an eighth transistor between the third node and the first power source, and configured to be turned on when the low emission control signal is supplied to the second emission control line.

DETAILED DESCRIPTION

Figure 1:
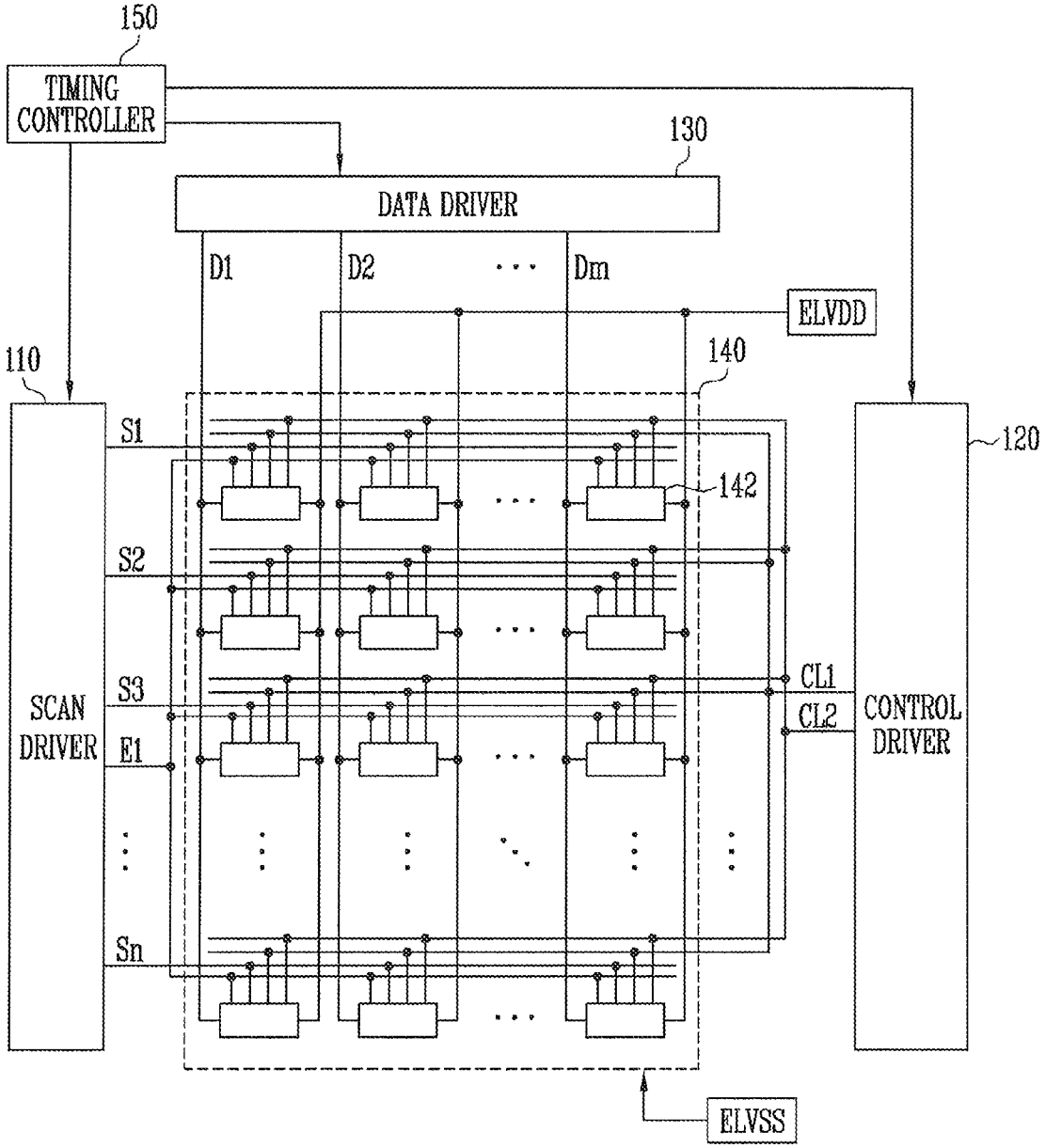
FIG. 1 is a block diagram illustrating an organic light emitting display according to an embodiment of the present invention.

Example embodiments of the present invention will now be described more fully hereinafter with reference to the accompanying drawings. However, the described embodiments of the present invention may be embodied in different forms, and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be, the only element between the two elements, or one or more intervening elements may also be present. Like reference numerals refer to like elements throughout.

Here, when a first element is described as being coupled to a second element, the first element may be directly coupled to the second element, and may also be indirectly coupled to the second element via one or more other elements.

Further, some of the elements that are not essential to the complete understanding of the invention are omitted for clarity. Also, like reference numerals refer to like elements throughout.

FIG. 1 is a block diagram illustrating an organic light emitting display according to an embodiment of the present invention. Referring to FIG. 1, the organic light emitting display according to the present embodiment includes a scan driver 110, a control driver 120, a data driver 130, a display unit 140, and a timing controller 150.

Figure 4:
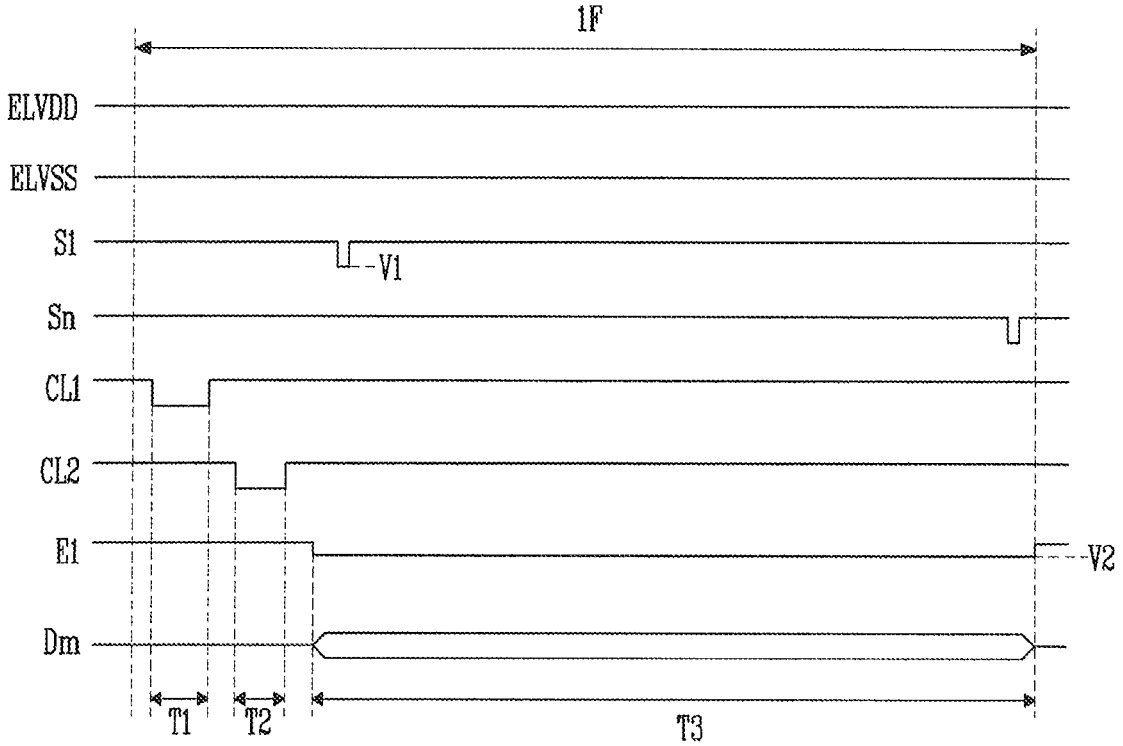
FIG. 4 is a waveform diagram illustrating an embodiment of a driving method of the pixel of the embodiment shown in FIG. 3.

FIG. 4 is a waveform diagram illustrating a driving method according to an embodiment of the present invention. As shown in FIG. 4, the scan driver 110 progressively supplies a scan signal to scan line S1 to Sn during a third period T3 in one frame 1F. If the scan signal is progressively supplied to the scan lines S1 to Sn, pixels 142 are selected for each horizontal line corresponding to a respective one of the scan lines S1 to Sn.

The scan driver 110 supplies a high emission control signal to a first emission control line E1 during first and second periods T1 and T2 in the one frame 1F, and supplies a low emission control signal to the first emission control line E1 during the third period T3 in the one frame 1F. Two or more organic light emitting diodes (e.g., OLED1 and OLED2 in FIG. 2) included in each pixel 142 are in a non-emission state during a period in which the high emission control signal is supplied to the first emission control line E1, and are in an emission state during a period in which the low emission control signal is supplied to the first emission control line E1.

Additionally, the scan driver 110 supplies a scan signal set to a first voltage V1, and supplies a low emission control signal set to a second voltage V2 different from the first voltage V1. In the present embodiment, the first voltage V1 is a low voltage so that a transistor receiving the scan signal supplied from the scan driver 110 is completely turned on, and the second voltage V2 is a voltage that is greater (e.g., higher) than the first voltage V1.

The data driver 130 supplies a data signal(s) to the data lines D1 to Dm in coordination with the scan signal. Then, the data signal is supplied to the pixels 142 from respective ones of the data lines D1 to Dm as selected by the scan signal.

The control driver 120 supplies a first control signal to a first control line CL1 during the first period T1 in the one frame 1F, and supplies a second control signal to a second control line CL2 during the second period in the one frame 1F. In the present embodiment, the first and second control signals are set to a voltage at which transistors included in the pixels 142 can be turned on. For example, the first and second control signals may be set to the first voltage V1.

The display unit 140 includes pixels 142 positioned in an area defined by the scan lines S1 to Sn and the data lines D1 to Dm. The pixels 142 charge a data signal of a current frame (e.g., a current data signal), and also emit light corresponding to a data signal of the previous frame (e.g., a previous data signal) during the third period T3 in the current frame. To this end, the pixels 142 control the amount of current flowing from a first power source ELVDD to a second power source ELVSS via respective organic light emitting diodes corresponding to the previous data signal during the third period T3 in the current frame.

Meanwhile, although the present embodiment describes each pixel 142 as coupled to a respective one of the scan lines (any one of S1 to Sn), a respective one of the data lines (any one of D1 to Dm), the first control line CL1, the second control line CL2, and the emission control line E1, the present invention is not limited thereto. Signal lines coupled to the pixels 142 may be changed in other embodiments of the present invention corresponding to the structure of the pixels 142.

Figure 2:
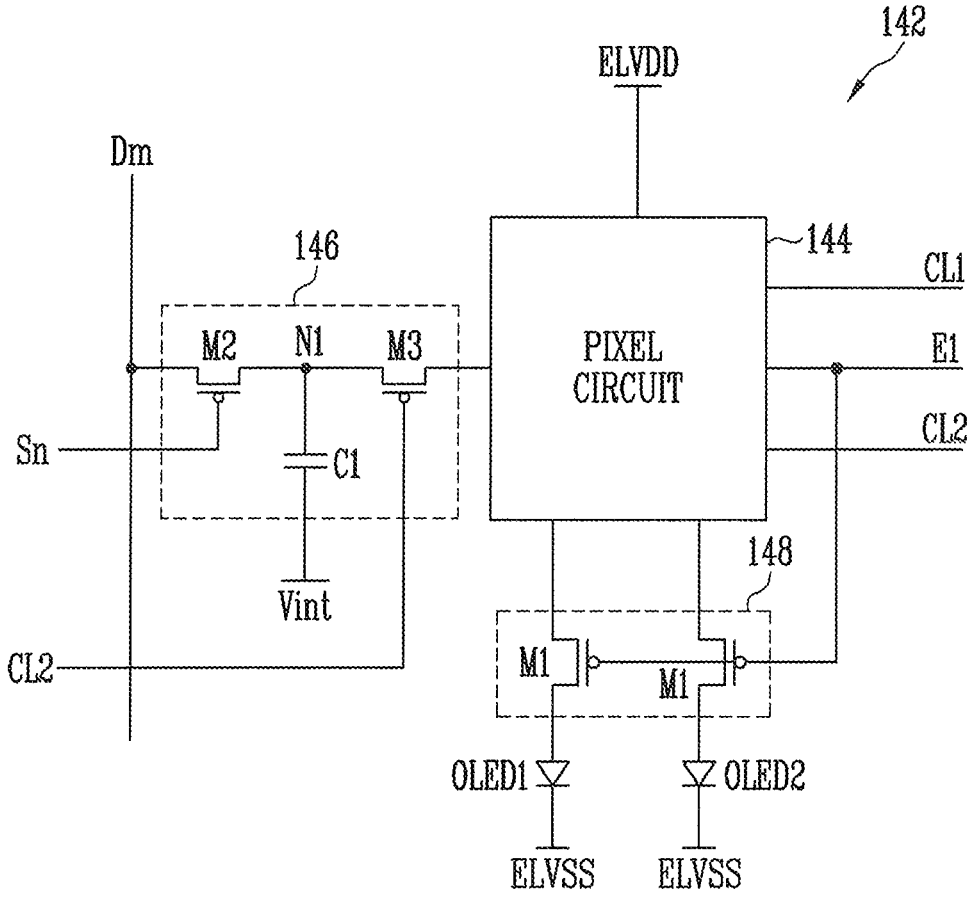
FIG. 2 is a circuit diagram illustrating a pixel according to an embodiment of the present invention.

FIG. 2 is a circuit diagram illustrating a pixel 142 according to the present embodiment of the present invention. For convenience of illustration, a pixel 142 coupled to an m-th data line Dm and an n-th scan line Sn is shown in FIG. 2.

Referring to FIG. 2, the pixel 142 according to the present embodiment includes a plurality of organic light emitting diodes OLED1 and OLED2, a pixel circuit 144 configured to control the amount of current supplied to the organic light emitting diodes OLED1 and OLED2, a selection unit 148 configured to control the coupling of the pixel circuit 144 to the organic light emitting diodes OLED1 and OLED2, and a driving unit 146 configured to store a data signal (e.g., a current data signal).

An anode electrode of the first organic light emitting diode OLED1 is coupled to the selection unit 148, and a cathode electrode of the first organic light emitting diode OLED1 is coupled to the second power source ELVSS. The first organic light emitting diode OLED1 generates light (e.g., light with a predetermined luminance) corresponding to the amount of current supplied from the pixel circuit 144 via the selection unit 148.

An anode electrode of the second organic light emitting diode OLED2 is coupled to the selection unit 148, and a cathode electrode of the second organic light emitting diode OLED2 is coupled to the second power source ELVSS. The second organic light emitting diode OLED2 generates light (e.g., light with a predetermined luminance) corresponding to the amount of current supplied from the pixel circuit 144 via the selection unit 148.

The driving unit 146 stores data signals (e.g., a current data signal supplied in the current frame from the data line Dm), and also supplies data signals (e.g., a previous data signal stored in the previous frame). To this end, the driving unit 146 includes a second transistor M2, a third transistor M3 and a first capacitor C1.

A first electrode of the second transistor M2 is coupled to the data line Dm, and a second electrode of the second transistor M2 is coupled to a first node N1. A gate electrode of the second transistor M2 is coupled to the scan line Sn. The second transistor M2 is turned on when a scan signal is supplied to the scan line Sn so as to supply the data signal from the data line Dm to the first node N1.

A first electrode of the third transistor M3 is coupled to the first node N1, and a second electrode of the third transistor M3 is coupled to the pixel circuit 144. A gate electrode of the third transistor M3 is coupled to the second control line CL2. The third transistor M3 is turned on when a second control signal is supplied to the second control line CL2 so as to electrically couple the first node N1 to the pixel circuit 144.

The first capacitor C1 is coupled between the first node N1 and a fixed voltage source (e.g., an initialization power source Vint). The first capacitor C1 charges a voltage corresponding to the data signal (e.g., the current data signal), which is supplied during a period in which the second transistor M2 is turned on. Additionally, in other embodiments of the present invention, the driving unit 146 may be omitted corresponding to the structure of the pixel circuit 144.

The pixel circuit 144 charges a voltage corresponding to the data signal stored in the first capacitor C1. The pixel circuit 144 controls the amount of current supplied from the first power source ELVDD to the selection unit 148, corresponding to the charged voltage. The pixel circuit 144 may be implemented with various types of circuits currently known in the art.

The selection unit 148 includes a first transistor M1 (e.g., first transistors M1) coupled between the pixel circuit 144 and each of (e.g., respective ones of) the organic light emitting diodes OLED1 and OLED2. The first transistors M1 are turned off when the high emission control signal is supplied to the first emission control line E1, and are turned on or turned off when the low emission control signal is supplied to the first emission control line E1 depending on conditions of the first transistors M1 (e.g., depending on whether the anode electrodes of the organic light emitting diodes OLED1 and OLED2 are set to the voltage of the second power source ELVSS, or are set higher than the voltage of the second power source ELVSS).

When the first and second organic light emitting diodes OLED1 and OLED2 are normally driven, the first transistors M1 are set in a turn-on state when the low emission control signal is supplied to the first emission control line E1. Conversely, when a defect such as a dark spot occurs in one of the organic light emitting diodes, such as in the first organic light emitting diode OLED1, the first transistor M1 coupled to the first organic light emitting diode OLED1 maintains a turn-off state even though the low emission control signal is supplied to the first emission control line E1.

When the first organic light emitting diode OLED1 is normally driven (e.g., when the anode and cathode electrodes of the first organic light emitting diode OLED1 are not short-circuited), the voltage at the anode electrode of the first organic light emitting diode OLED1 is greater/higher than that of the second power source ELVSS. Conversely, when a defect such as a dark spot occurs in the first organic light emitting diode OLED1 due to a short circuit between the anode and cathode electrodes of the first organic light emitting diode OLED1, the voltage at the anode electrode of the first organic light emitting diode OLED1 is the same as the voltage of the second power source ELVSS.

Meanwhile, the low emission control signal is set to the second voltage V2 so that the first transistor(s) M1 is/are turned off when the anode electrodes of the organic light emitting diodes OLED1 and OLED2 are set to the voltage of the second power source ELVSS, and is/are turned on when the anode electrodes of the organic light emitting diodes OLED1 and OLED2 are set to a voltage higher/greater than that of the second power source ELVSS. Then, the first transistors M1 coupled to the respective organic light emitting diodes OLED1 and OLED2 are set in the turn-on state when the organic light emitting diodes OLED1 and OLED2 are normally driven, and are set in the turn-off state when a defect such as a dark spot occurs.

That is, in embodiments of the present invention, it is possible to prevent the first organic light emitting diode OLED1 and the pixel circuit 144 from being electrically coupled to each other when a defect, such as a dark spot, occurs in the first organic light emitting diode OLED1, while it also being possible that the second organic light emitting diode OLED2, in which no defect occurs, can normally implement luminance, thereby improving display quality.

If the first organic light emitting diode OLED1 in which a defect occurs is not electrically coupled to the pixel circuit 144, the amount of current supplied to the second organic light emitting diode OLED2 is increased, and accordingly, it is possible to implement an image with a desired gray scale. Experimentally, when the pixel 142 is normally driven, the luminance of the pixel 142 is set to 100%, and if a defect, such as a dark spot, occurs in one of the organic light emitting diodes OLED1 and OLED2, the pixel 142 emits light with a luminance of about 90% or more.

Additionally, if the first transistor M1 is turned on corresponding to the low emission control signal, the voltages at the anode electrodes of the organic light emitting diodes OLED1 and OLED2 are increased corresponding to the current supplied from the pixel circuit 144. Thus, the first transistor M1 can stably maintain the turn-on state, corresponding to the low emission control signal.

Meanwhile, although it has been described in the present embodiment that the first and second organic light emitting diodes OLED1 and OLED2 are coupled to the selection unit 148, the present invention is not limited thereto, and additional organic light emitting diodes may be coupled to the selection unit 148 in other embodiments of the present invention.

Figure 3:
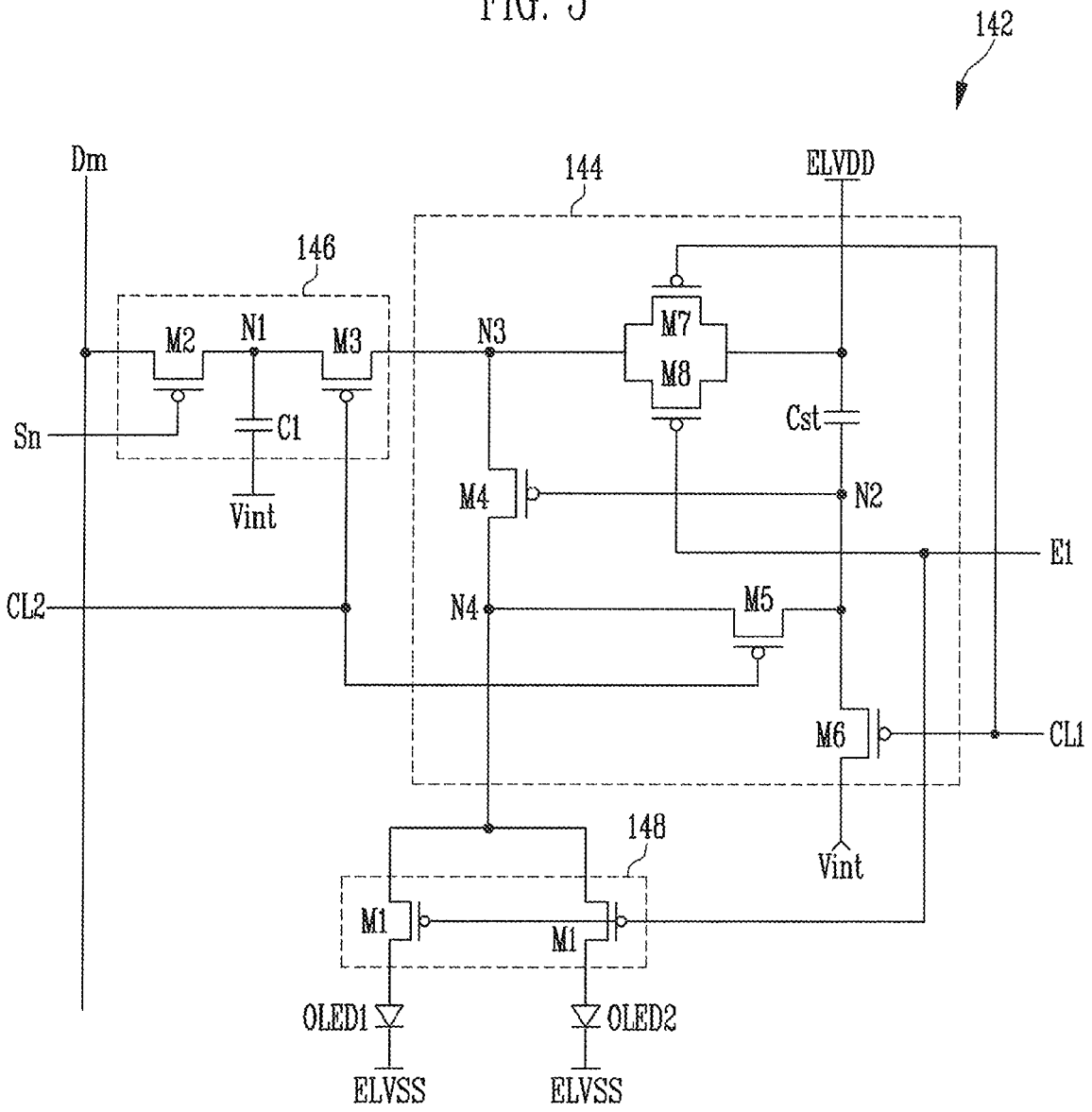
FIG. 3 is a circuit diagram illustrating an embodiment of a pixel circuit of the embodiment shown in FIG. 2.

FIG. 3 is a circuit diagram illustrating an embodiment of the pixel circuit shown in FIG. 2. Referring to FIG. 3, the pixel circuit 144 according to the present embodiment includes fourth, fifth, sixth, seventh, and eighth transistors M4 to M8, and a storage capacitor Cst.

A first electrode of the fourth transistor M4, which is a driving transistor, is coupled to a third node N3, and a second electrode of the fourth transistor M4 is coupled to the selection unit 148 at a fourth node N4. A gate electrode of the fourth transistor M4 is coupled to a second node N2. The fourth transistor M4 controls the amount of current supplied to the selection unit 148 corresponding to a voltage applied to the second node N2.

A first electrode of the fifth transistor M5 is coupled to the fourth node N4, and a second electrode of the fifth transistor M5 is coupled to the second node N2. A gate electrode of the fifth transistor M5 is coupled to the second control line CL2. The fifth transistor M5 is turned on when the second control signal is supplied to the second control line CL2 so as to electrically couple the second and fourth nodes N2 and N4 to each other. If the second and fourth nodes N2 and N4 are electrically coupled to each other, the fourth transistor M4 is diode-coupled.

A first electrode of the sixth transistor M6 is coupled to the second node N2, and a second electrode of the sixth transistor M6 is coupled to the initialization power source Vint. A gate electrode of the sixth transistor M6 is coupled to the first control line CL1. The sixth transistor M6 is turned on when the first control signal is supplied to the first control line CL1 so as to apply the voltage of the initialization power source Vint to the second node N2. Here, the initialization power source Vint is set to a voltage lower than that of the data signal.

A first electrode of the seventh transistor M7 is coupled to the first power source ELVDD, and a second electrode of the seventh transistor M7 is coupled to the third node N3. A gate electrode of the seventh transistor M7 is coupled to the first control line CL1. The seventh transistor M7 is turned on when the first control signal is supplied to the first control line CL1 so as to apply the voltage of the first power source ELVDD to the third node N3.

A first electrode of the eighth transistor M8 is coupled to the first power source ELVDD, and a second electrode of the eighth transistor M8 is coupled to the third node N3. A gate electrode of the eighth transistor M8 is coupled to the first emission control line E1. The eighth transistor M8 is turned on when the low emission control signal is supplied to the first emission control line E1, and is turned off when the high emission control signal is supplied to the first emission control line E1.

The storage capacitor Cst is coupled between the first power source ELVDD and the second node N2. The storage capacitor Cst charges a previous data signal stored in the first capacitor C1 and a voltage corresponding to the threshold voltage of the fourth transistor M4.

Referring back to FIG. 4, which is a waveform diagram illustrating an embodiment of a driving method of the pixel shown in FIG. 3, the one frame 1F according to the present embodiment is divided into a first period T1, a second period T2, and a third period T3. The first period T1 is a period in which the second node N2 is initialized, and the second period T2 is a period in which the previous data signal stored in the driving unit 146 is supplied to the pixel circuit 144. The third period T3 is a period in which the current data signal is stored, and in which the pixel emits light corresponding to the previous data signal.

First, the high emission control signal is supplied to the first emission control line E1 during the first and second periods T1 and T2. If the high emission control signal is supplied to the first emission control line E1, the eighth transistor M8 and the first transistors M1 are turned off, so that the organic light emitting diodes OLED1 and OLED2 are set in a non-emission state.

During the first period T1, the first control signal is supplied to the first control line CL1. If the first control signal is supplied to the first control line CL1, the sixth and seventh transistors M6 and M7 are turned on. If the seventh transistor M7 is turned on, the voltage of the first power source ELVDD is supplied to the third node N3. If the sixth transistor M6 is turned on, the voltage of the initialization power source Vint is supplied to the second node N2. Here, the initialization power source Vint is set to a voltage lower than that of the data signal, and hence the fourth transistor M4 is initialized in an on-bias state during the first period T1.

During the second period T2, the second control signal is supplied to the second control line CL2. If the second control signal is supplied to the second control line CL2, the third and fifth transistors M3 and M5 are turned on. If the fifth transistor M5 is turned on, the fourth transistor M4 is diode-coupled. If the third transistor M3 is turned on, the voltage of the previous data signal stored in the first capacitor C1 is applied to the third node N3. Accordingly, the voltage at the second node N2 is initialized as the voltage of the initialization power source Vint, which is lower than that of the data signal, and hence the fourth transistor M4 is turned on. If the fourth transistor M4 is turned on, the voltage applied to the third node N3 is applied to the second node N2 via the diode-coupled fourth transistor M4 and via the fifth transistor M5, thereby causing the storage capacitor Cst to store a data signal and a voltage corresponding to the threshold voltage of the fourth transistor M4.

During the third period T3, the low emission control signal is supplied to the first emission control line E1. If the low emission control signal is supplied to the first emission control line E1, the first transistors M1 included in the selection unit 148 and the seventh transistor M7 are turned on. In this case, the fourth transistor M4 controls the amount of current flowing from the first power source ELVDD to the second power source ELVSS via the organic light emitting diodes OLED1 and OLED2 corresponding to the voltage applied to the second node N2. Here, each organic light emitting diode OLED1 or OLED2 generates light (e.g., light with a predetermined luminance) corresponding to the amount of the current supplied thereto.

Additionally, when a defect such as a dark spot occurs in one of the organic light emitting diodes OLED1 or OLED2, the first transistor M1 coupled to the defective organic light emitting diode OLED1 or OLED2 remains off even though the low emission control signal is supplied to the first emission control line E1. Thus, in embodiments of the present invention, it is possible to stably display an image even though a defect such as a dark spot occurs in one of the organic light emitting diode OLED1 or OLED2.

Meanwhile, a scan signal is progressively supplied to the scan lines S1 to Sn during the third period T3. If the scan signal is supplied to the n-th scan line Sn, the second transistor M2 is turned on. If the second transistor M2 is turned on, a current data signal supplied from the data line Dm is stored in the first capacitor C1. Practically, in embodiments of the present invention, a predetermined gray scale is implemented by repeating the aforementioned procedure.

Figure 5:
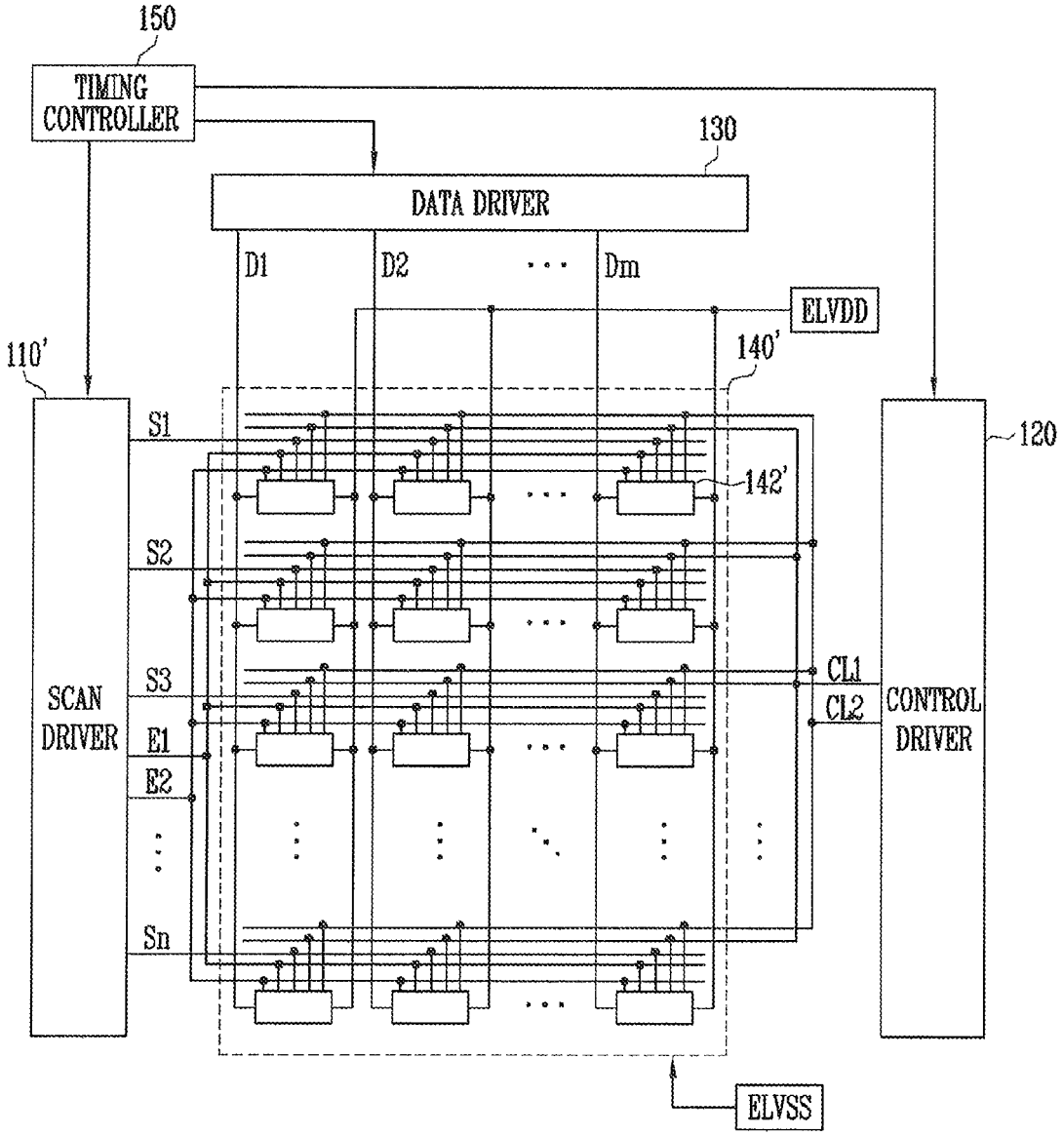
FIG. 5 is a block diagram illustrating an organic light emitting display according to another embodiment of the present invention.

FIG. 5 is a block diagram illustrating an organic light emitting display according to another embodiment of the present invention. In FIG. 5, components identical to those of FIG. 1 are designated by like reference numerals, and their detailed descriptions will be omitted. Referring to FIG. 5, the organic light emitting display according to the present embodiment includes a scan driver 110', a control driver 120, a data driver 130, a display unit 140 and a timing controller 150.

Figure 8:
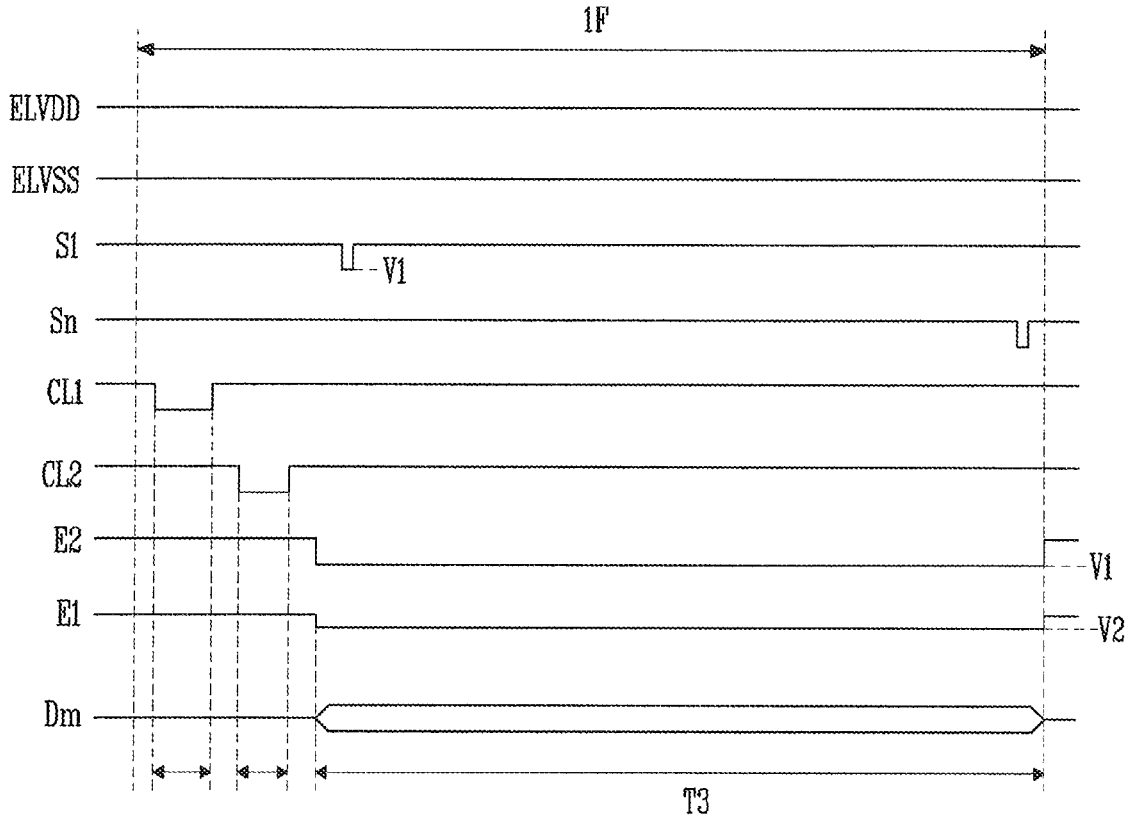
FIG. 8 is a waveform diagram illustrating an embodiment of a driving method of the pixel of the embodiment shown in FIG. 7.

The scan driver 110' drives a second emission control line E2 commonly coupled to pixels 142. For example, as shown in FIG. 8, the scan driver 110' supplies a high emission control signal to the second emission control line E2 during first and second periods T1 and T2 in one frame 1F, and supplies a low emission control signal to the second emission control line E2 during a third period T3 in the one frame 1F. Here, the low emission control signal supplied to the second emission control line E2 is set to a voltage (e.g., a first voltage V1, which is lower than a second voltage V2). In the present embodiment, the other components except those corresponding to the second emission control line E2 are identical to those of FIG. 1, and accordingly, their detailed descriptions will be omitted.

Figure 6:
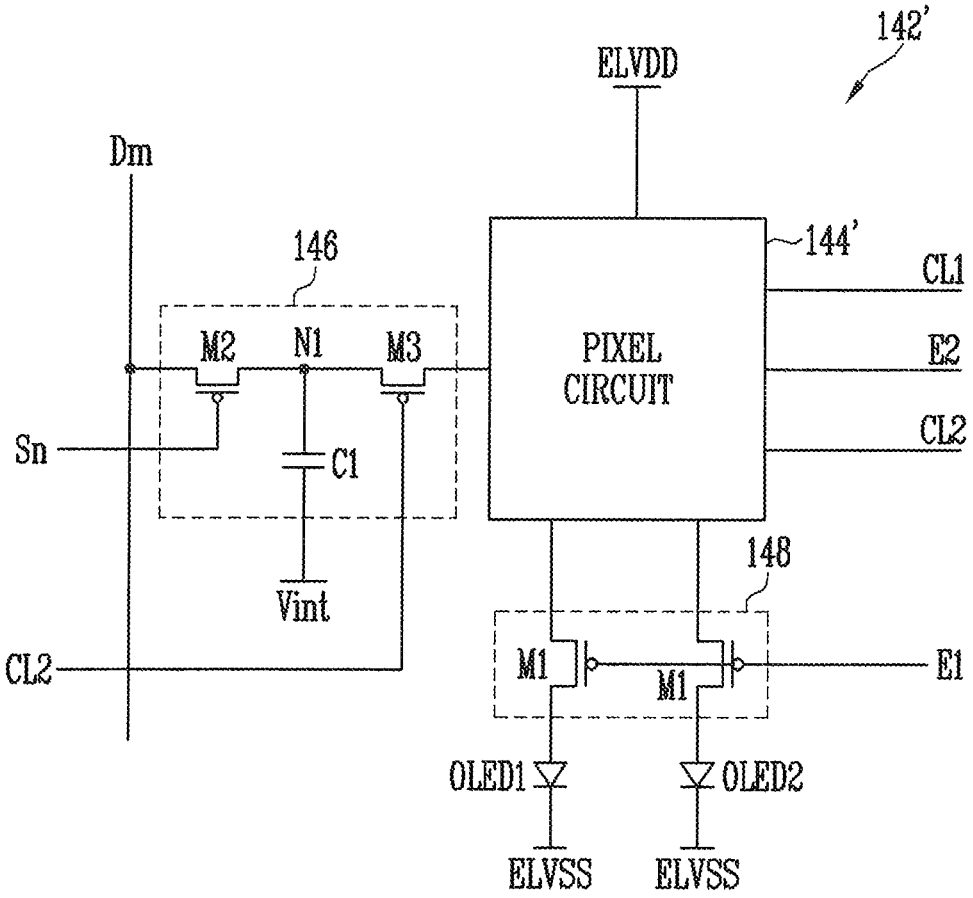
FIG. 6 is a circuit diagram illustrating a pixel according to an embodiment of the present invention.

FIG. 6 is a circuit diagram illustrating a pixel 142 according to the embodiment of the present invention. In FIG. 6, components identical to those of FIG. 2 are designated by like reference numerals, and their detailed descriptions will be omitted. Referring to FIG. 6, the pixel 142 according to the present embodiment includes a plurality of organic light emitting diodes OLED1 and OLED2, a pixel circuit 144' configured to control the amount of current supplied to the organic light emitting diodes OLED1 and OLED2, a selection unit 148 configured to control electric coupling of the pixel circuit 144' to the organic light emitting diodes OLED1 and OLED2, and a driving unit 146 configured to store a current data signal.

The pixel circuit 144' is coupled to the second emission control line E2. That is, one of the transistors included in the pixel circuit 144' is driven corresponding to the high or low emission control signal supplied to the second emission control line E2. In the pixel 142 of the present embodiment, with the exception of the pixel circuit 144' coupled to the second emission control line E2, the other components are identical to those of FIG. 2, and accordingly, their detailed descriptions will be omitted.

Figure 7:
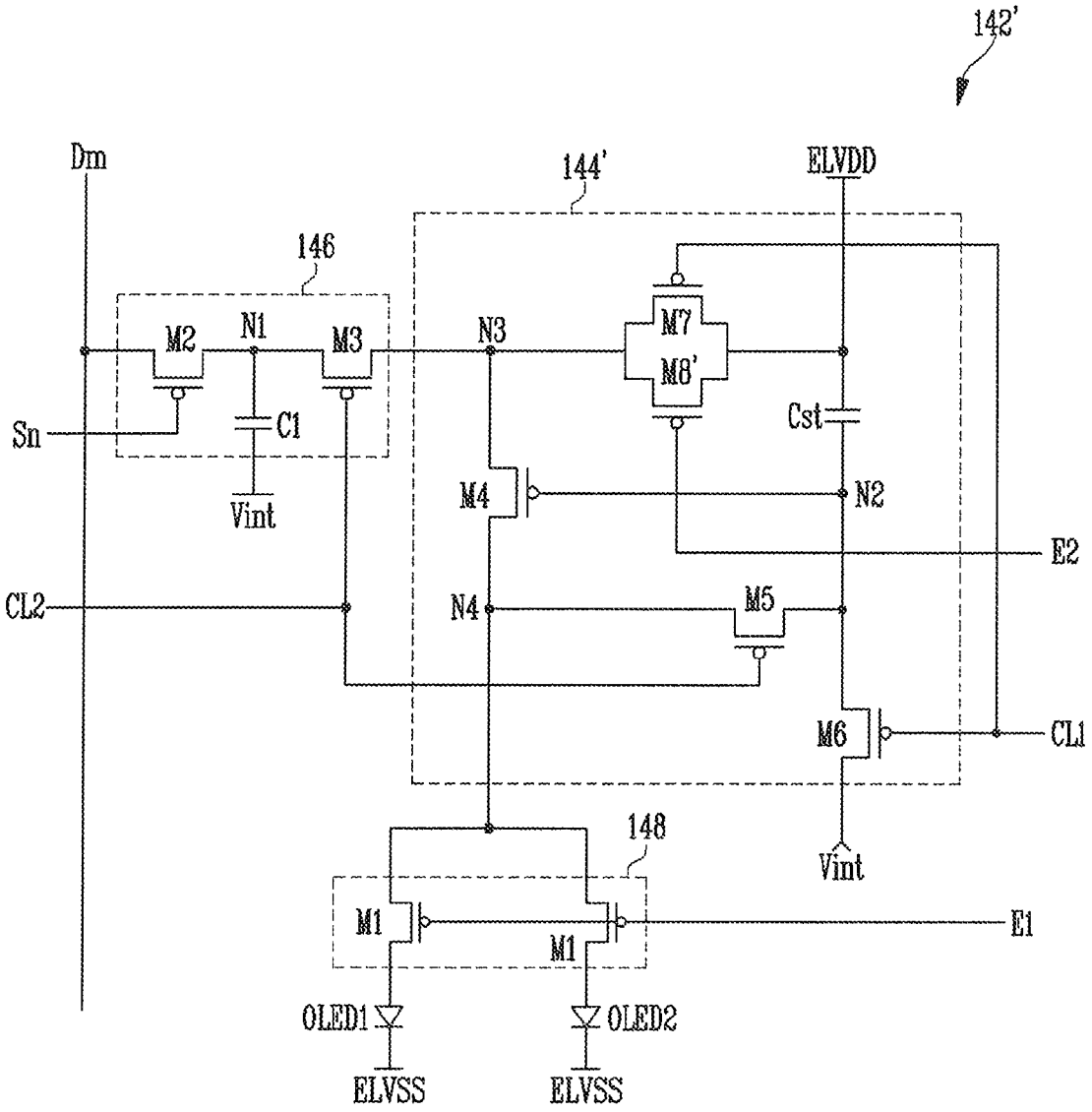
FIG. 7 is a circuit diagram illustrating an embodiment of a pixel circuit of the embodiment shown in FIG. 6.

FIG. 7 is a circuit diagram illustrating an embodiment of a pixel circuit 144' shown in FIG. 6. In FIG. 7, components identical to those of FIG. 3 are designated by like reference numerals, and their detailed descriptions will be omitted. Referring to FIG. 7, an eighth transistor M8' included in the pixel circuit 144' is coupled between the first power source ELVDD and the third node N3. A gate electrode of the eighth transistor M8' is coupled to the second emission control line E2. The eighth transistor M8' is turned off when the high emission control signal is supplied to the second emission control line E2, and is turned on when the low emission control signal is supplied to the second emission control line E2.

That is, the eighth transistor M8' is turned on during the third period T3 in the one frame 1F, and is turned off during the first and second periods T1 and T2 in the one frame 1F. Additionally, the low emission control signal supplied to the second emission control line E2 is set to the first voltage V1, which is lower than the second voltage V2, causing the turn-on resistance of the eighth transistor M8' to be comparatively decreased.

FIG. 8 is a waveform diagram illustrating an embodiment of a driving method of the pixel 142 shown in FIG. 7. In FIG. 8, detailed descriptions of portions identical to those of FIG. 4 will be omitted. Referring to FIG. 8, a low emission control signal of the second voltage V2 is supplied to the first emission control line E1, and a low emission control signal of the first voltage V1 is supplied to the second emission control line E2.

If the low emission control signal of the second voltage V2 is supplied to the first emission control line E1, the first transistors M1 are selectively turned on depending on the existence of a defect, such as a dark spot, in the organic light emitting diodes OLED1 and OLED2, and accordingly, it is possible to improve display quality.

If the low emission control signal of the first voltage V1 is supplied to the second emission control line E2, the turn-on resistance of the eighth transistor M8' is decreased, thereby improving the reliability of driving. The other processes in the driving method of the present embodiment are similar to those of FIG. 4, and therefore, their detailed descriptions will be omitted.

Additionally, although it has been described in the embodiments of the present invention that the transistors are shown as PMOS transistors for convenience of illustration, the present invention is not limited thereto. For example, the transistors may be formed as NMOS transistors.

In embodiments of the present invention, the organic light emitting diode OLED generates light of a given color corresponding to the amount of current supplied from the driving transistor. However, the present invention is not limited thereto. For example, the organic light emitting diode OLED may generate white light, corresponding to the amount of the current supplied from the driving transistor. Accordingly, a color image may be implemented using a separate color filter or the like in embodiments of the present invention.

By way of summation and review, an organic light emitting display displays an image using organic light emitting diodes. In the organic light emitting displays, a defect, such as a dark spot, may occur in an organic light emitting diode due to a short circuit between anode and cathode electrodes of the organic light emitting diode. When a defect such as a dark spot occurs before a product is released, a repair process using laser or the like may be performed. However, a defect such as a dark spot that occurs after the panel is released is more difficult to repair, and accordingly, the display quality of the organic light emitting display is lowered.

In the pixel and the organic light emitting display using the same according to embodiments of the present invention, a plurality of organic light emitting diodes are provided in each pixel, and an organic light emitting diode in which a defect such as a dark spot occurs is automatically decoupled from the pixel circuit. That is, although a defect such as a dark spot occurs in a given organic light emitting diode among the plurality of organic light emitting diodes, it is possible to stably display an image.

Example embodiments have been disclosed herein, and although specific terms are employed, they are used in, and are to be interpreted in, a generic and descriptive sense only, and are not to be used or interpreted for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A pixel comprising:

a plurality of organic light emitting diodes, each of which comprising a cathode electrode coupled to a second power source;

a pixel circuit coupled to a scan line and to a data line, the pixel circuit configured to control current supplied from a first power source to the organic light emitting diodes corresponding to a data signal supplied to the data line; and first transistors between the pixel circuit and respective ones of the organic light emitting diodes, the first transistors configured to be turned on or to be turned off when a low emission control signal is supplied to a first emission control line, wherein a scan signal supplied to the scan line is a first voltage, wherein the low emission control signal is a second voltage that is different than the first voltage, and wherein the first transistors are implemented as same channel type transistors.

2. The pixel of claim 1, wherein the second voltage is greater than the first voltage.

3. The pixel of claim 1, wherein, due to the second voltage, one of the first transistors is configured to be turned off when the voltage of the second power source is applied to an anode electrode of a corresponding one of the organic light emitting diodes.

4. The pixel of claim 1, wherein, due to the second voltage, one of the first transistors is configured to be turned on when a voltage greater than that of the second power source is applied to an anode electrode of a corresponding one of the organic light emitting diodes.

5. The pixel of claim 1, further comprising a driving unit configured to store a current data signal of a current frame supplied from the data line, and configured to provide a previous data signal of a previous frame to the pixel circuit.

6. An organic light emitting display device comprising:

a scan driver configured to supply a scan signal to scan lines, and configured to supply a high emission control signal and a low emission control signal to a first emission control line;

a data driver configured to supply a data signal to data lines; and pixels corresponding to respective ones of the scan lines and the data lines, wherein each of the pixels comprises:

a plurality of organic light emitting diodes each comprising a cathode electrode coupled to a second power source;

a pixel circuit configured to control current supplied from a first power source to the organic light emitting diodes corresponding to the data signal; and first transistors between the pixel circuit and respective ones of the organic light emitting diodes, and configured to be turned on or turned off when the low emission control signal is supplied to the first emission control line, wherein the scan signal is set to a first voltage, wherein the low emission control signal is set to a second voltage that is different than the first voltage, and wherein the first transistors are implemented as same channel type transistors.

7. The organic light emitting display device of claim 6, wherein the second voltage is greater than the first voltage.

8. The organic light emitting display device of claim 6, wherein, due to the voltage of the second voltage, one of the first transistors is configured to be turned off when the voltage of the second power source is applied to an anode electrode of a corresponding one of the organic light emitting diodes.

9. The organic light emitting display device of claim 6, wherein, due to the voltage of the second voltage, one of the first transistors is configured to be turned on when a voltage greater than that of the second power source is applied to an anode electrode of a corresponding one of the organic light emitting diodes.

10. The organic light emitting display device of claim 6, wherein the first transistors are configured to be turned off by the high emission control signal.

11. An organic light emitting display device comprising:

a scan driver configured to supply a scan signal to scan lines, and configured to supply a high emission control signal and a low emission control signal to a first emission control line;

a data driver configured to supply a data signal to data lines; and pixels corresponding to respective ones of the scan lines and the data lines, wherein each of the pixels comprises:

a plurality of organic light emitting diodes each comprising a cathode electrode coupled to a second power source;

a pixel circuit configured to control current supplied from a first power source to the organic light emitting diodes corresponding to the data signal; and first transistors between the pixel circuit and respective ones of the organic light emitting diodes, and configured to be turned on or turned off when the low emission control signal is supplied to the first emission control line, wherein the scan signal is set to a first voltage, wherein the low emission control signal is set to a second voltage that is different than the first voltage, wherein the scan driver is configured to progressively supply the scan signal to the scan lines during a third period in one frame, and wherein the scan driver is configured to supply the high emission control signal to the first emission control line during a first period and a second period in the one frame, and is configured to supply the low emission control signal to the first emission control line during the third period.

12. The organic light emitting display device of claim 11, further comprising a control driver configured to supply a first control signal to a first control line commonly coupled to the pixels during the first period, and configured to supply a second control signal to a second control line commonly coupled to the pixels during the second period.

13. The organic light emitting display device of claim 12, wherein each pixel further comprises a driving unit configured to store a current data signal of a current frame supplied from a corresponding one of the data lines, and configured to provide a previous data signal of a previous frame to the pixel circuit.

14. The organic light emitting display device of claim 13, wherein the driving unit comprises:

a second transistor between the data line and a first node, and configured to be turned on when the scan signal is supplied;

a third transistor between the first node and the pixel circuit, and configured to be turned on when the second control signal is supplied; and a first capacitor between the first node and an initialization power source.

15. The organic light emitting display device of claim 12, wherein the pixel circuit comprises:

a fourth transistor between a third node and a fourth node, and configured to control current flowing from the first power source to the first transistors according to a voltage applied to a second node;

a fifth transistor between the fourth and second nodes, and configured to be turned on when the second control signal is supplied; and a storage capacitor between the second node and the first power source.

16. The organic light emitting display device of claim 15, wherein the pixel circuit further comprises:

a sixth transistor between the second node and an initialization power source, and configured to be turned on when the first control signal is supplied;

a seventh transistor between the third node and the first power source, and configured to be turned on when the first control signal is supplied; and an eighth transistor between the third node and the first power source, and configured to be turned on when the low emission control signal is supplied to the first emission control line.

17. The organic light emitting display device of claim 15, wherein the scan driver is configured to supply the high emission control signal to a second emission control line commonly coupled to the pixels during the first period and the second period, and is configured to supply the low emission control signal to the second emission control fine during the third period.

18. The organic light emitting display device of claim 17, wherein the low emission control signal supplied to the second emission control line is a voltage that is lower than the second voltage.

19. The organic light emitting display device of claim 17, wherein the low emission control signal supplied to the second emission control line is the first voltage.

20. The organic light emitting display device of claim 17, wherein the pixel circuit further comprises:

a sixth transistor between the second node and an initialization power source, and configured to be turned on when the first control signal is supplied;

a seventh transistor between the third node and the first power source, and configured to be turned on when the first control signal is supplied; and an eighth transistor between the third node and the first power source, and configured to be turned on when the low emission control signal is supplied to the second emission control line.

* * * * *